US009402489B2

(12) United States Patent
Clearman

(10) Patent No.: US 9,402,489 B2
(45) Date of Patent: Aug. 2, 2016

(54) PORTABLE BLANKET WITH FOLDING GUIDE

(71) Applicant: CLEARMAN LABS LLC, Redwood City, CA (US)

(72) Inventor: Christopher Aaron Clearman, Redwood City, CA (US)

(73) Assignee: Clearman Labs LLC, Redwood City, CA (US)

( * ) Notice: Subject to any disclaimer, the term of this patent is extended or adjusted under 35 U.S.C. 154(b) by 0 days.

(21) Appl. No.: 14/688,115

(22) Filed: Apr. 16, 2015

(65) Prior Publication Data

US 2015/0305525 A1 Oct. 29, 2015

Related U.S. Application Data

(60) Provisional application No. 61/995,991, filed on Apr. 28, 2014.

(51) Int. Cl.
*A47G 9/00* (2006.01)
*A47G 9/06* (2006.01)

(52) U.S. Cl.
CPC ..... *A47G 9/062* (2013.01)

(58) Field of Classification Search
CPC ..... A47G 9/00
USPC ..... 5/417–420, 482, 486
See application file for complete search history.

(56) References Cited

U.S. PATENT DOCUMENTS 6,275,993 B1 * 8/2001 McCarley ..... A41D 15/04 2/209.11
6,845,518 B1 * 1/2005 Boesen ..... A41D 3/04 2/86
2008/0127414 A1 * 6/2008 Allen ..... A47G 9/062 5/417

OTHER PUBLICATIONS

Parasheet Quick-Dry Beach Sheet. Datasheet [online]. The Grommet 2015 [retrieved on Jul. 20, 2015]. Retrieved from the Internet: <URL: https://www.thegrommet.com/parasheet-quickdry-beach-sheet.

* cited by examiner

*Primary Examiner* — Fredrick Conley
(74) *Attorney, Agent, or Firm* — Trego, Hines & Ladenheim, PLLC

(57) ABSTRACT

A portable blanket is made from flexible material and has opposed front and back faces bounded by perimeter edges, and has a first surface area in an unfolded condition. The flexible material incorporates a folding guide thereon, the folding guide having lines which represent a sequence of two or more folds defining a folded condition of the blanket, the folded condition having a second surface area smaller than the first surface area.

14 Claims, 5 Drawing Sheets

PORTABLE BLANKET WITH FOLDING GUIDE

BACKGROUND OF THE INVENTION

This invention relates generally to blankets and tarps, and more particularly to blankets which can be folded for storage.

Blankets, tarps, and similar items are often used on the ground to keep a person clean and dry, for example when camping or attending outdoor entertainment events.

While useful for this purpose, blankets can be bulky and therefore inconvenient to store and transport. It is possible to reduce a blanket's bulk by folding it. However, it can be difficult or impossible to fold a blanket in the correct sequence needed to form a compact package.

Accordingly, there remains a need for a blanket which can be easily folded into a compact package after use.

BRIEF SUMMARY OF THE INVENTION

This need is addressed by the present invention, which provides a portable blanket incorporating a guide illustrating a folding pattern for storage.

According to one aspect of the invention, a portable blanket is made from flexible material and has opposed front and back faces bounded by perimeter edges, and has a first surface area in an unfolded condition. The flexible material incorporates a folding guide thereon, the folding guide having lines which represent a sequence of two or more folds defining a folded condition of the blanket, the folded condition having a second surface area smaller than the first surface area.

According to another aspect of the invention, lines include a marking material applied to at least one of the front and back faces.

According to another aspect of the invention, the lines comprise thread stitched to the flexible material.

According to another aspect of the invention, the flexible material is formed in a rectangle with four linear peripheral edges and four corners.

According to another aspect of the invention, the lines represent sequential half folds of the flexible material.

According to another aspect of the invention the lines represent a series of half folds, which each fold being along a line perpendicular to the previous fold in the series.

According to another aspect of the invention, the second surface area is approximately 1/256 of the first surface area.

According to another aspect of the invention, the flexible material includes fabric.

According to another aspect of the invention the blanket further includes a storage pouch attached to the flexible material.

According to another aspect of the invention, the storage pouch includes a carrying handle.

According to another aspect of the invention, the storage pouch includes a cover flap.

According to another aspect of the invention, the blanket further includes at least one weight of dense material attached thereto.

According to another aspect of the invention, the blanket further includes at least one eyelet attached thereto.

According to another aspect of the invention, the blanket further includes a storage tray attached thereto, the storage tray including a floor and a perimeter wall.

According to another aspect of the invention, the storage tray comprises molded plastic.

According to another aspect of the invention, the storage tray is attached to the flexible material by stitching.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
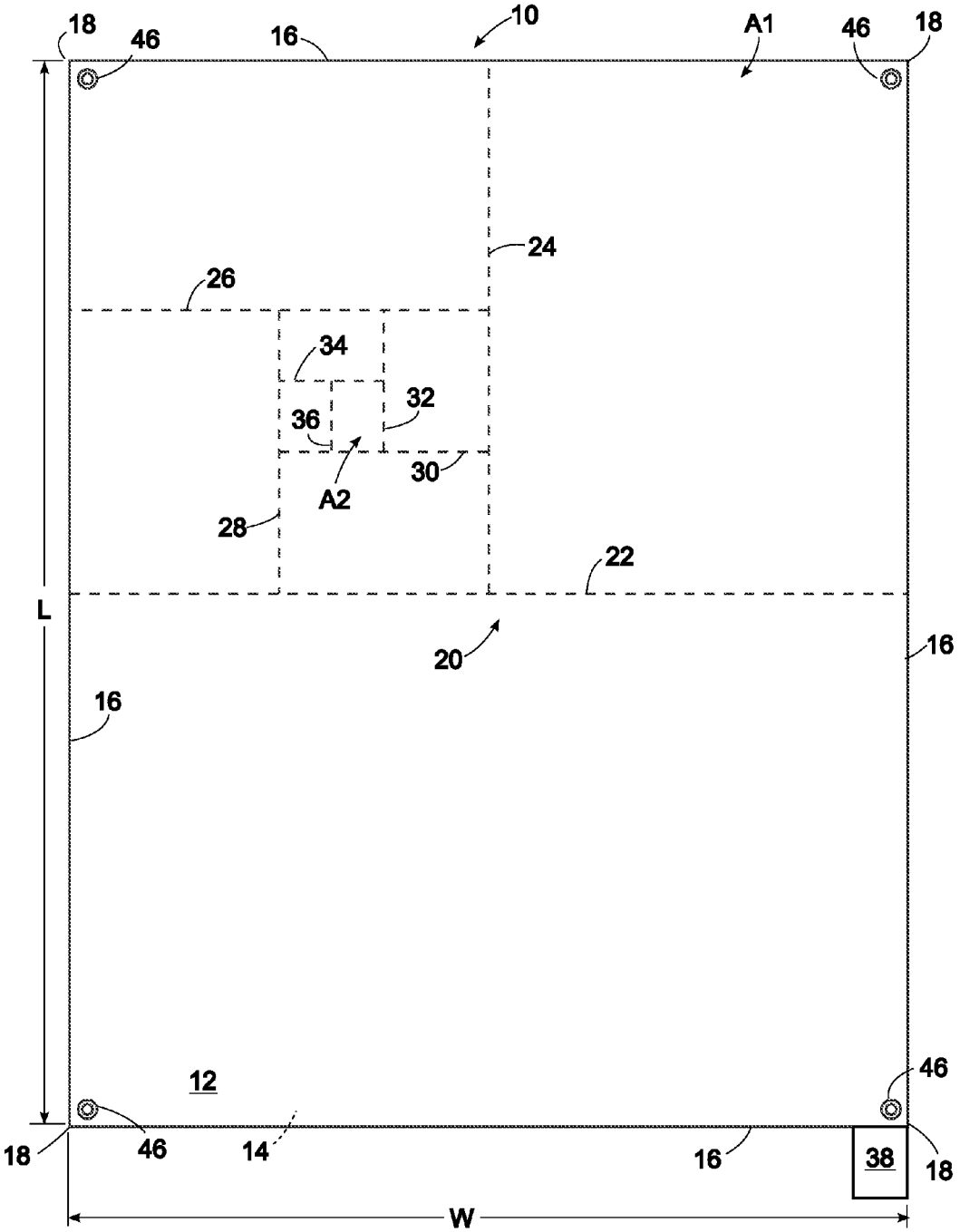
FIG. 1 is a schematic plan view of a portable blanket constructed in accordance with an aspect of the present invention.

Referring to the drawings wherein identical reference numerals denote the same elements throughout the various views, FIG. 1 illustrates an exemplary blanket 10 constructed according to an aspect of the present invention.

The blanket 10 comprises a sheet of flexible material with opposed front and back faces 12, 14 bounded by peripheral edges 16, collectively defining an outer periphery of the blanket 10. In the illustrated example the blanket 10 is rectangular and has four peripheral edges 16 which meet each other at four corners 18. Other shapes may be used.

The flexible material may be any material which is capable of being folded and subsequently unfolded while maintaining its structural integrity. Nonlimiting examples of suitable materials include woven and nonwoven fabrics, and rubber, plastic, and/or fibrous sheet material. Depending on the intended use of the blanket 10, the flexible material may be air-permeable or air-impermeable, and may be waterproof or water-resistant. The flexible material may including one or more coatings to modify its properties, for example a polymeric waterproofing coating. In general, thicker materials provide greater isolation from the ground surface, while thinner materials are easier to fold.

At least one of the front and back faces 12, 14 incorporates a folding guide 20 comprising lines which depict a pattern or series of folds that will reduce the surface area of the blanket 10 from a first size or surface area "A1" to a final, smaller size or surface area "A2". It will be understood that as used herein, the term "surface area" refers to the surface area of the front or back face 12, 14 in plan view; for purposes of illustration the surface area A1 of the blanket 10 as seen in FIG. 1 would be its length "L" multiplied by its width "W".

In the illustrated example the folding guide 20 is configured to produce a series of folds that divide the exposed surface area of the blanket 10 in half, with each fold being along a line perpendicular to the previous fold. This may be referred to as a "half fold". There are eight lines labeled 22, 24, 26, 28, 30, 32, 34, and 36 guiding a user to eight sequential folds. The series of folds may be described as following a spiral pattern inwards. As each fold halves the exposed surface area, the final size A2 is 1/256 of the original size A1. Other patterns and numbers of folds may be implemented.

The folding pattern may be implemented using any durable marking method. For example, the lines 22-36 may be marked on the surface with printing ink, paint, or dye applied to the front and/or back faces 12, 14, or woven into the body of the blanket 10, or applied by stitching lines of thread into the blanket 10. The lines 22-36 may be of a contrasting color from the rest of the blanket 10 to promote visibility. If desired the folding guide 20 may incorporate additional instructions in the form of text, arrows, etc. (not shown)

Figure 2:
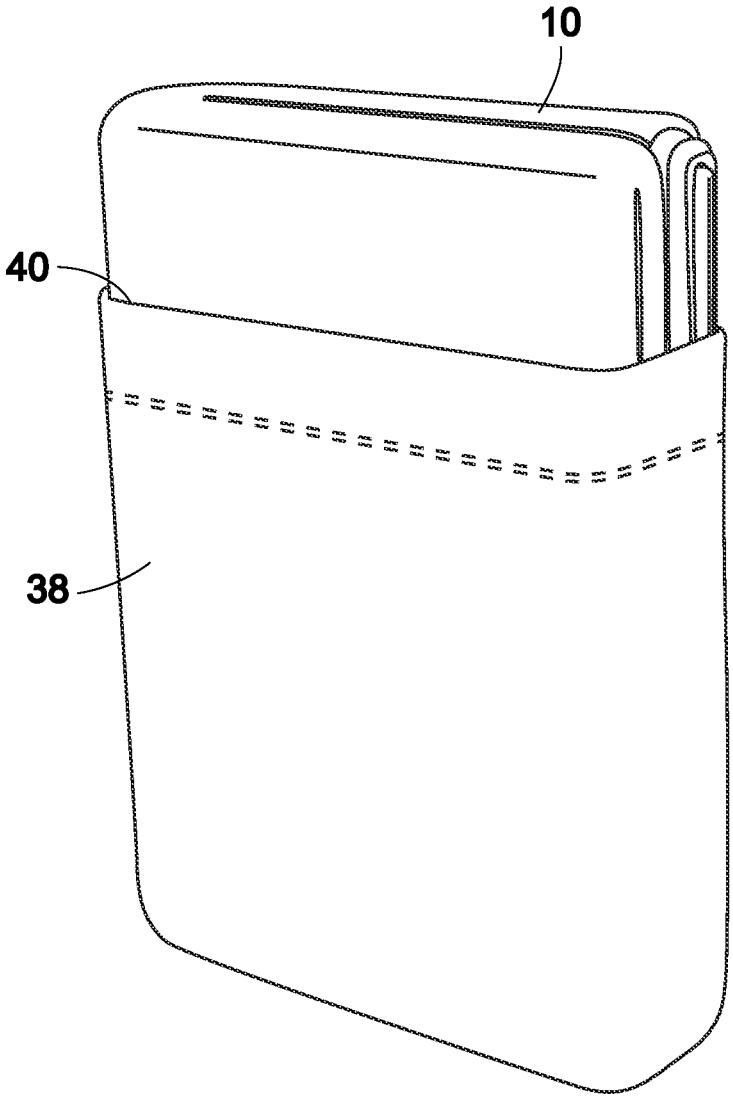
FIG. 2 is a schematic perspective view of the blanket of FIG. 1, folded and placed inside a storage pouch.
Figure 3:
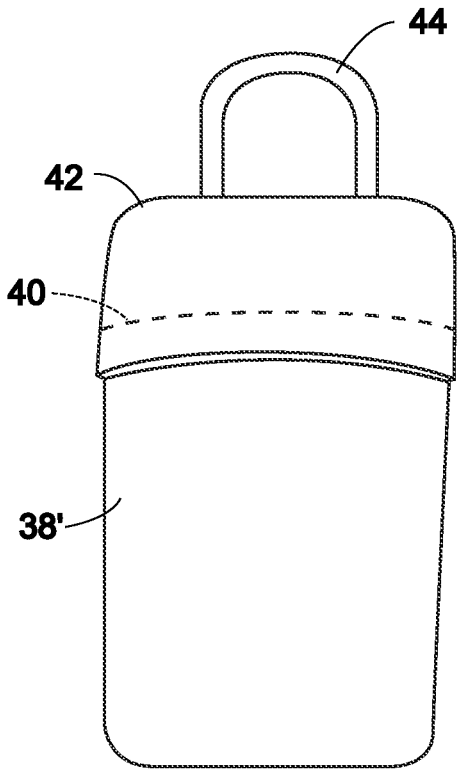
FIG. 3 is a schematic front view of an alternative storage pouch.

When folded the blanket 10 may be stored in a fabric pouch or similar small container. FIG. 2 shows the folded blanket 10 disposed inside a fabric pouch 38 with an opening 40. As shown in FIG. 1, the pouch 38 may be attached to one of the peripheral edges 16 of the blanket 10. FIG. 3 shows an alternative pouch 38' generally similar to the pouch 40 with the inclusion of a cover flap 42 to cover the opening 40' and a loop or handle 44 for carrying or attaching the folded blanket 10.

Optionally, the blanket 10 can include one or more weights 46 (see FIG. 1) to prevent the blanket 10 from moving in windy environments. The weights 46 may be made from a dense material such as metal and may be attached by crimping in the manner of a conventional grommet, encapsulated in fabric and stitching, or any other secure other manner. The weights 46 may be attached anywhere, but for best effectiveness would be secured near the perimeter of the blanket 10. In the illustrated example, one weight 46 is disposed at each corner of the rectangular blanket 10.

In use, the blanket 10 would be removed from the pouch 38, unfolded, and then laid on the ground or other surface. A user can then sit or lay on the blanket 10, remaining clean and dry regardless of the ground condition. When the user is finished with the blanket, it can be easily folded using the folding guide 20 as described above and placed back in the pouch 38 without difficulty.

Figure 4:
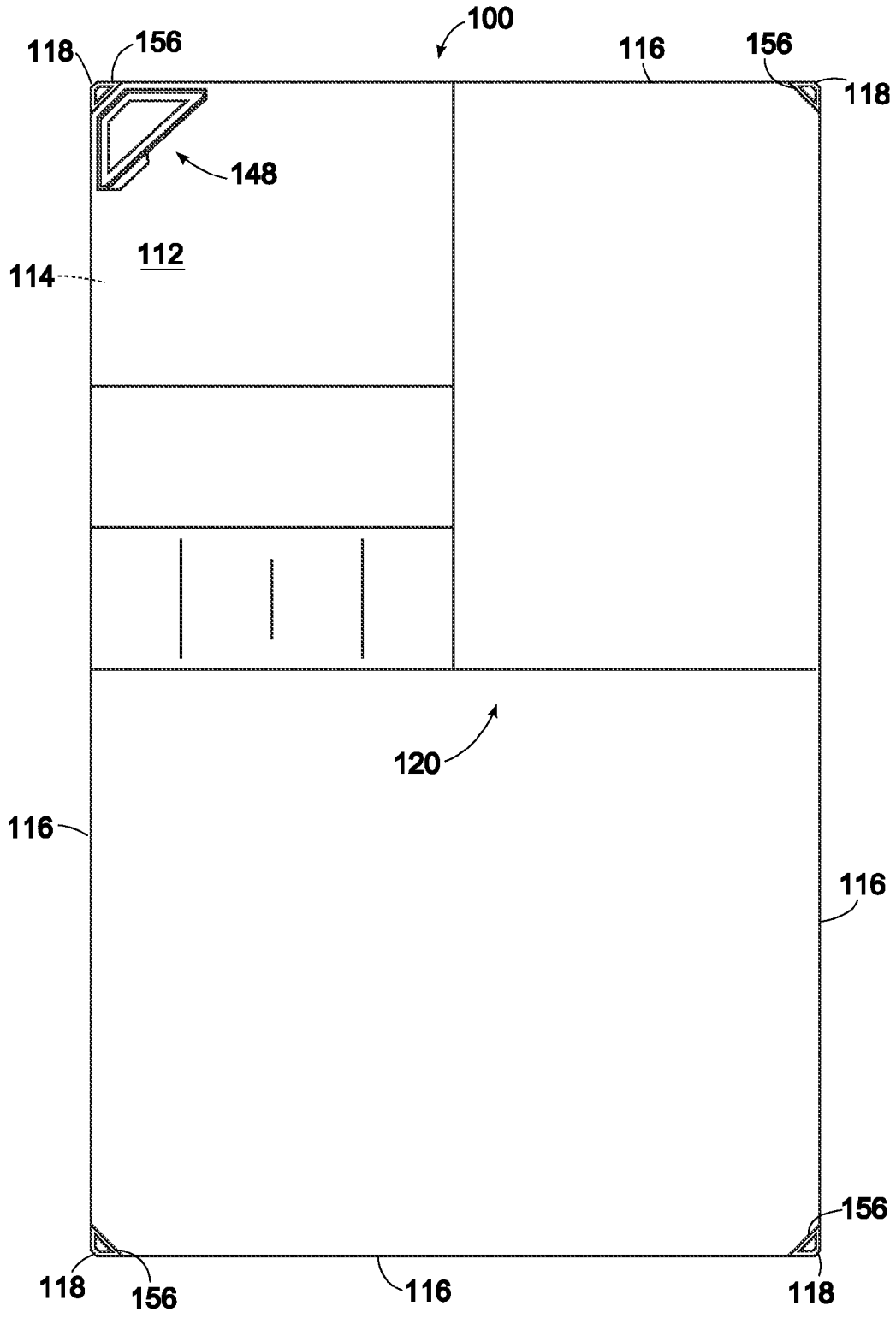
FIG. 4 is a schematic plan view of an alternative portable blanket.

The blanket 10 may be used in other environments. For example, FIG. 4 depicts an alternative blanket 100 which is particularly suitable for tasks such as automobile maintenance. The blanket 100 is similar in construction to the blanket 10 described above; elements of the blanket 100 not specifically described may be taken to be identical to the blanket 10. The blanket 100 includes front and back faces 112, 114, bounded by peripheral edges 116, and corners 118. The blanket 100 incorporates a folding guide 120 generally similar to the folding guide 20 described above. The pattern of folds may be varied to suit the thickness of the material and does not necessarily have to include a series of half-folds as described above. To suit its usage for automobile maintenance, it may be made of a material which is resistant to oil, grease, and/or solvents.

Figure 5:
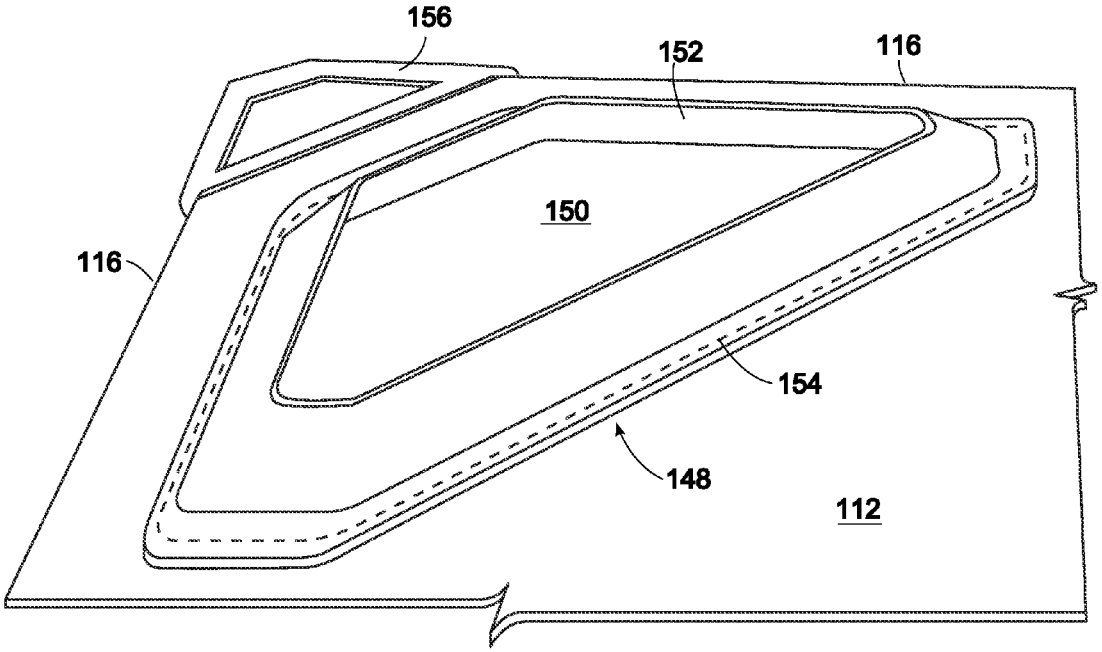
FIG. 5 is a perspective view of a portion of the blanket of FIG. 4, showing a storage tray thereof.

The blanket 100 may include a storage tray 148, which is shown in more detail in FIG. 5. The storage tray 148 is a small, open-topped container with a floor 150 and a perimeter wall 152. The storage tray 148 may be made from a material such as silicone rubber, molded plastic, or other material that will hold a desired shape. It is attached to the blanket 100, for example using the illustrated stitching 154 or other appropriate fasteners. In the illustrated example the storage tray 148 has a trapezoidal shape, but other shapes are suitable as well. In use, the storage tray 148 provides a convenient place to store small parts, fasteners, or tools, which would otherwise be easily lost or tend to roll away.

Optionally, the blanket 100 can include one or more eyelets or grommets 156 to allow the blanket 100 to be secured. The grommets 156 may be attached by crimping, for example. The blanket 10 may also incorporate grommets if desired.

The foregoing has described a portable blanket. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

What is claimed is:

1. A portable blanket, comprising flexible material and having opposed front and back faces bounded by perimeter edges, and having a first surface area in an unfolded condition, the flexible material incorporating a folding guide thereon, the folding guide comprising marked lines which represent a series of sequential half folds disposed in a spiral pattern, wherein each fold is along a line perpendicular to the previous fold in the series, the series of sequential half folds defining a folded condition of the blanket, the folded condition having a second surface area smaller than the first surface area.

2. The blanket of claim 1 wherein the lines comprise a marking material applied to at least one of the front and back faces.

3. The blanket of claim 1 wherein the lines comprise thread stitched to the flexible material.

4. The blanket of claim 1 wherein the flexible material is formed in a rectangle with four linear peripheral edges and four corners.

5. The blanket of claim 1 further including a storage tray attached thereto, the storage tray including a floor and a perimeter wall.

6. The blanket of claim 5 wherein the storage tray comprises molded plastic.

7. The blanket of claim 6 wherein the storage tray is attached to the flexible material by stitching.

8. The blanket of claim 1 wherein the flexible material comprises fabric.

9. The blanket of claim 1 further including a storage pouch attached to the flexible material.

10. The blanket of claim 9 wherein the storage pouch includes a carrying handle.

11. The blanket of claim 9 wherein the storage pouch includes a cover flap.

12. The blanket of claim 1 further including at least one weight of dense material attached thereto.

13. The blanket of claim 1 further including at least one eyelet attached thereto.

14. The blanket of claim 1 wherein the second surface area is approximately 1/256 of the first surface area.

* * * * *